US007828678B1

(12) United States Patent
Caruso

(10) Patent No.: US 7,828,678 B1
(45) Date of Patent: Nov. 9, 2010

(54) SOCCER GOAL FOR USE ON SHARED FIELDS

(75) Inventor: Anthony Caruso, Center Valley, PA (US)

(73) Assignee: Kwik Goal Ltd., Quakertown, PA (US)

( * ) Notice: Subject to any disclaimer, the term of this patent is extended or adjusted under 35 U.S.C. 154(b) by 278 days.

(21) Appl. No.: 11/946,224

(22) Filed: Nov. 28, 2007

(51) Int. Cl.
*A63B 69/00* (2006.01)
*A63B 67/00* (2006.01)

(52) U.S. Cl. ..... 473/416; 473/478

(58) Field of Classification Search ..... 473/416, 473/168, 478; 135/160; 248/237, 352; 273/410; 403/297; 414/922, 924; D21/302, 709
See application file for complete search history.

(56) References Cited

U.S. PATENT DOCUMENTS

| | | | | |
|---|---|---|---|---|
| 4,169,598 | A | 10/1979 | Taylor | |
| 4,407,507 | A | 10/1983 | Caruso et al. | |
| 4,702,478 | A * | 10/1987 | Kruse | 273/127 B |
| 5,080,375 | A * | 1/1992 | Moosavi | 473/478 |
| 5,249,796 | A | 10/1993 | Silvi | |
| 5,476,266 | A | 12/1995 | Caruso | |
| 5,513,843 | A | 5/1996 | Russell | |
| 5,599,024 | A | 2/1997 | Acuff et al. | |
| 5,651,551 | A | 7/1997 | Ferrara et al. | |
| 5,865,693 | A * | 2/1999 | Johnson | 473/478 |
| 6,322,461 | B1 * | 11/2001 | Walsh | 473/422 |
| 6,899,645 | B1 | 5/2005 | Hsiao | |
| 7,074,141 | B2 * | 7/2006 | Bryant et al. | 473/478 |
| 7,241,235 | B2 | 7/2007 | Caruso | |
| 7,331,880 | B2 * | 2/2008 | Rogers | 473/478 |
| 2006/0199674 | A1 | 9/2006 | Rogers | |
| 2006/0202426 | A1 | 9/2006 | Tennett, Sr. | |
| 2007/0144081 | A1 | 6/2007 | Caruso | |
| 2007/0194534 | A1 | 8/2007 | Caruso | |

OTHER PUBLICATIONS

Webpage download, Sportsauthority, 2004, http://www.sportsauthority.com/product/index.jsp?productId=1418774&kw=1418774&sr=1&origkw=141, 2 pages.*
Webpage download, Harrod, 2006, http://www.harrod.uk.com/Products.aspx?id=535, 3 pages.*

* cited by examiner

*Primary Examiner*—Gene Kim
*Assistant Examiner*—M Chambers
(74) *Attorney, Agent, or Firm*—Howson & Howson LLP

(57) ABSTRACT

A sports goal assembly having a goal frame defining an upright goalmouth on a shared soccer/football playing field is provided. The goal frame includes a spaced-apart, opposed pair of elongate base rails that each extend rearward of the goalmouth and along and parallel to an underlying surface of the playing field to support the goal assembly on the playing field. An elongate base crossbar interconnects the base rails and extends transversely therebetween. Each of the elongate base rails includes a front section adjacent the goalmouth, a rear section remote from the goalmouth, and an intermediate section. The base crossbar is connected to, and extends from, the intermediate sections of the base rails, and the rear sections of the base rails include counterbalancing weights to stabilize the goal assembly.

7 Claims, 2 Drawing Sheets

SOCCER GOAL FOR USE ON SHARED FIELDS

BACKGROUND OF THE INVENTION

The present invention relates to sports goals and like assemblies, and more particularly, to a portable or semi-permanent soccer goal capable of fitting within limited space available between a support post of football uprights and an endline of a shared soccer/football playing field.

At many institutions, schools, and the like, one or more indoor or outdoor playing fields are often efficiently used for both soccer and football games, practices, clinics, and the like. A typical arrangement includes football upright goal posts located adjacent opposite endlines of the shared playing field. When the shared field is utilized for soccer, portable or semi-permanent soccer goals are positioned in generally the same location as the football uprights adjacent each endline of the playing field.

Football uprights are generally permanent structures that are only disassembled and removed during off-season periods, if at all. The presence of the football uprights prevent a standard full-sized soccer goal from fitting within the space typically available between the endline of the playing field and the support post of the football uprights. This problem is further exaggerated if the soccer goal includes a rigid base crossbar, which is typically desired.

U.S. Patent Application Publication No. 2006/0199674 A1 of Rogers discloses an example of a shared playing field on which a soccer goal and football uprights are positioned. U.S. Pat. No. 5,513,843 issued to Russell, U.S. Pat. No. 5,249,796 issued to Silvi, U.S. Pat. No. 4,169,598 issued to Taylor, and U.S. Pat. No. 6,899,645 B1 issued to Hsiao disclosure various convertible soccer/football structures.

A problem specific to soccer goals, particularly portable soccer goals that are not permanently affixed to the underlying ground surface, is that they can tip over for various reasons and cause injury. In some situations, such as on an artificial surface, ground anchors cannot be used. Examples of anchors and the like for preventing soccer goals from tipping over, in general, are provided by U.S. Pat. No. 5,651,551 issued to Ferrara et al., U.S. Pat. No. 4,407,507 issued to Caruso et al., and U.S. Pat. No. 5,599,024 issued to Acuff et al. and by U.S Patent Application Publication Nos. 2007/0194534 A1 and 2007/0144081 A1 of Caruso and 2006/0202426 A1 of Tennett.

Although the soccer goals and anchor devices disclosed in the above referenced patents and published applications may be satisfactory for their intended purposes, there is a need for a novel soccer goal capable of fitting cleanly adjacent an endline in front of football uprights on a shared soccer/football playing field. Preferably, the goal should be portable or only semi-permanent enabling ready removal of the goal from the field when the field is used for football. Also, the goal should resist tipping to prevent injuries and preferably should include a base crossbar that does not interfere with placement of the goal between the endline and the football uprights. Further, the goal should be capable of being readily placed and removed from various indoor and outdoor playing surfaces in a manner requiring a minimum of time, effort, skill and labor.

SUMMARY OF THE INVENTION

The present invention is a sports goal assembly having a goal frame defining an upright goalmouth on a playing field. The goal frame includes a spaced-apart, opposed pair of elongate base rails that each extend rearward of the goalmouth and along and parallel to an underlying surface of the playing field to support the goal assembly on the playing field. An elongate base crossbar interconnects the base rails and extends transversely therebetween. Each of the elongate base rails includes a front section adjacent the goalmouth, a rear section remote from the goalmouth, and an intermediate section located between the front and rear sections. The base crossbar is connected to, and extends from, the intermediate sections of the base rails. In at least some contemplated embodiments of the present invention, the rear sections of the base rails include counterbalancing weights.

According to another aspect of the present invention, a shared soccer/football playing field endline arrangement is provided. The arrangement includes football uprights having a support post projecting from a ground surface a spaced distance behind an endline of a playing field, and a soccer goal positioned between the support post of the football uprights and the endline of the playing field. The soccer goal has a rigid frame including a pair of spaced-apart upright goal posts and a crossbar that together define a goalmouth on or closely adjacent the endline, a spaced-apart pair of elongate base rails extending rearward from lower ends of the goal posts, and a base crossbar interconnecting the pair of base rails and extending transversely therebetween. Each elongate base rail includes a front section adjacent the goalmouth, an intermediate section, and a rear section remote from the goalmouth. The rear sections of the base rails are located a greater distance behind the endline of the playing field then the support post of the football uprights, and the base crossbar extends from the intermediate sections of the base rails at a location between the endline of the playing field and the support post of the football uprights. Preferably, the rear sections of the base rails include counterbalancing weights.

BRIEF DESCRIPTION OF THE DRAWINGS

The present invention should become apparent from the following description when taken in conjunction with the accompanying drawings, in which.

DETAILED DESCRIPTION OF THE INVENTION

Figure 1:
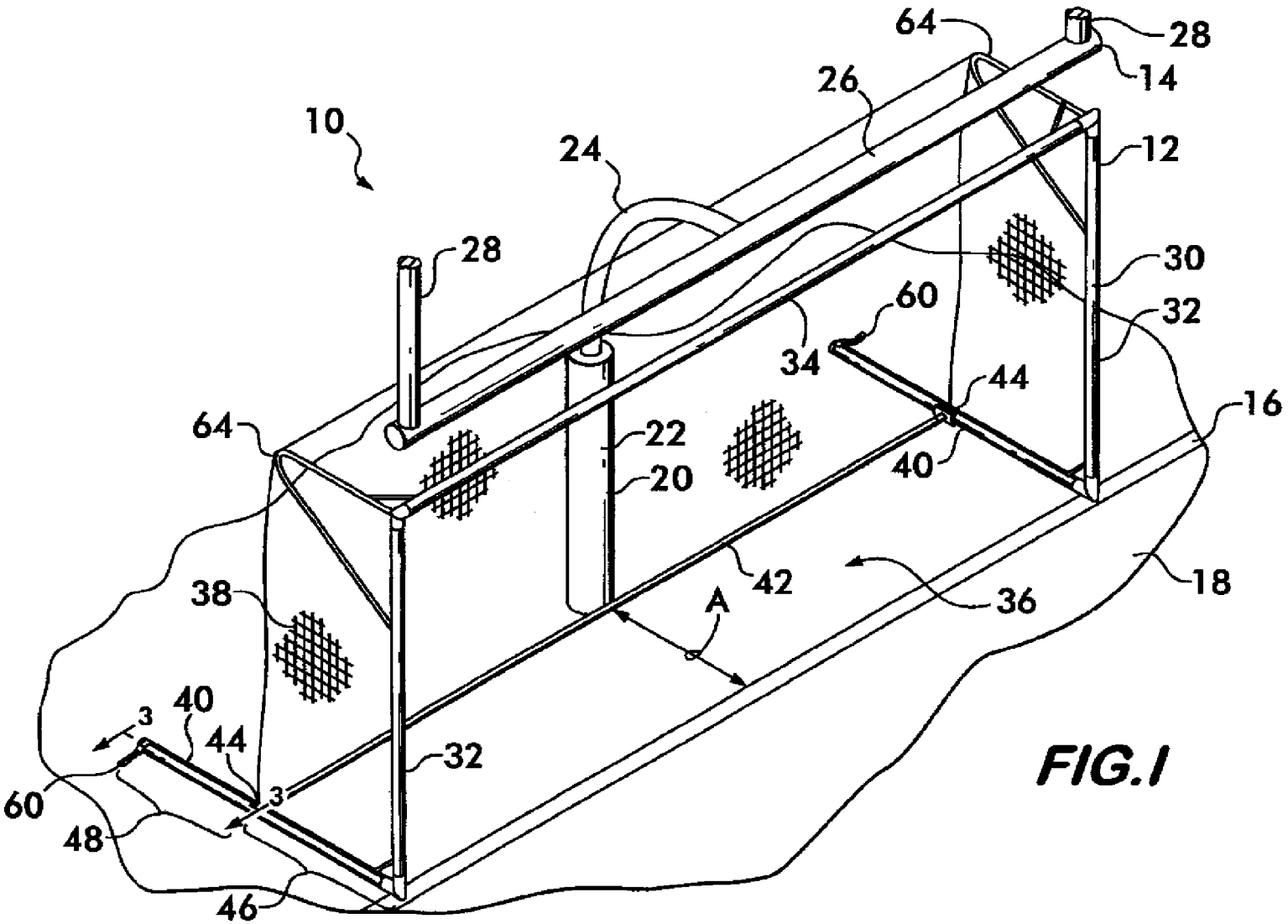
FIG. 1 is perspective view of a soccer goal according to the present invention positioned adjacent a football upright and an endline of a shared soccer/football playing field.

As best illustrated in FIG. 1, the present invention relates to a portable or semi-permanent soccer goal 12 and an arrangement 10 in which both football uprights 14 and the soccer goal 12 are positioned adjacent an endline 16 of a shared playing field 18. The goal 12 is defined as portable or semi-permanent in that it must be capable of being readily removed from the playing field 18 during periods of time when the playing field is used for football and also must be capable of ready positioning on the endline 16 of the playing field during periods of time when the playing field is used for soccer. Soccer and football are typically played in the same season, if not throughout the full year; thus, the removal and replacement of the soccer goal 12 can be required on a daily basis.

Football uprights 14 are typically permanent structures that are infrequently disassembled and removed, if at all. As illustrated in FIG. 1, the football uprights 14 include a support post 20 projecting from the ground a spaced distance "A" behind the endline 16 of the playing field 18. This distance, "A", can typically be about 5 feet. The support post 20 includes a generally vertical base portion 22 and an arcuate upper portion 24 that extends to a location directly above the endline 16. The support post 20 connects to a horizontally-disposed football goal post crossbar 26, which is typically located about ten feet above the surface of the playing field 18 directly above the endline 16. A pair of football goal post uprights 28 extends vertically from opposite ends of the crossbar 26.

The soccer goal 12 according to the present invention fits cleanly between the endline 16 of the playing field 18 and the support post 20 of the football uprights 14. See FIG. 1. As with a typical pocketed goal, the soccer goal 12 has a frame 30 including a pair of spaced-apart, vertically-disposed, rigid goal posts 32 and a crossbar 34 that together define a goalmouth 36 of the soccer goal 12. The goalmouth 36 extends upright from the surface of the playing field 18 and is typically located on or closely adjacent the endline 16 of the playing field 18. A standard full-size soccer goal typically requires a goalmouth 36 that is about eight feet high and twenty-four feet in length.

The soccer goal 12 includes additional framing elements needed to support a goal net 38 recessed from the goalmouth 36. There is limited space for the goal net 38 and the additional framing elements due to the presence of the support post 20 of the football uprights 14. In addition, it is preferable that the support post 20 remain a spaced distance behind the goal net 38 to prevent undesired contact with the post 20 and/or injury and to prevent soccer balls from undesirably ricocheting off the support post 20. Accordingly, the pocketed recessed netting of the goal must be relatively shallow when compared to those typically used for standard size goals.

Shallow goal structures are typically avoided since such structures are prone to undesirable tipping. Soccer goals tend to be relatively heavy (several hundred pounds) and are typically made from rigid metal or wooden materials. Thus, they can cause significant injury if permitted to tip. Portable or semi-permanent goals typically include base rails that engage the underlying ground surface and that support the upright goal posts and crossbar in the intended upright position. For purposes of stably supporting the goal frame, the base rails typically extend a length at least as great as the height of the upright goal posts. For instance, if the goal posts are eight feet in length, the base rails will be about eight feet in length. Base crossbars typically interconnect the ends of the base rails remote from the goalmouth so that the goal net can be properly held in place.

The problems with a shallow goal structure is overcome according to the present invention by the novel assembly and configuration of base rails, base crossbar, and counterbalancing weights. As best illustrated in FIG. 1, the goal 12 includes a pair of spaced-apart, horizontally-disposed, elongate base rails 40 extending rearward from the upright goal posts 32. Preferably, the base rails 40 extend at about a 90° angle relative to the goal posts 32 and the endline 16 of the playing field 18. As shown in FIG. 1, the elongate base rails 40 are generally of the same length as the upright goal posts 32.

An elongate base crossbar 42 extends transversely between the base rails 40 and interconnects to both base rails 40. However, unlike conventional goal structures, the base crossbar 42 connects to intermediate sections 44 of the base rails 40 between front sections 46 of the base rails 40 adjacent the goal posts 32 and rear sections 48 remote from the endline 16. Accordingly, in plan, the base rails 40 and base crossbar 42 have a substantially I-shaped configuration.

The net 38 is secured to the goal posts 32, crossbar 34, base crossbar 42, and the front sections 46 of the base rails, but does not connect to the rear sections 48 of the base rails 40. This arrangement of the net 38 and base crossbar 42 enables the soccer goal 12 to fit within the space available between the support post 20 of the football uprights 14 and the endline 16 of the playing field. See FIG. 1.

The rear sections 48 of the base rails 40 extend a significant distance beyond the interconnections between the base rails 40 and the base crossbar 42. For instance, the rear section 48 may be three feet or more for a base rail 40 of about eight feet in total length. Thus, in the arrangement 10 illustrated in FIG. 1, the rear sections 48 of the base rails 40 extend a greater distance from the endline 16 relative to distance "A" of the support post 20. This helps stabilize the soccer goal 12 and enables the goal 12 to resist tipping.

Preferably, the rear sections 48 of the base rails 40 are weighted in comparison to the front sections 44 of the base rails 40 for purposes of counterbalancing the goal 12. Thus, the rear sections 48 of the base rails 40 weigh more then the front sections 46 of the base rails 40. For example, the rear sections 48 can be enlarged and/or solid; whereas, the front sections 46 can be smaller and/or hollow. According to the illustrated embodiment, the entire base rail 40 is a hollow constant diameter tube, and a counterbalancing weight 50 is inserted only within the hollow rear section 48 of each base rail 40. See FIGS. 2-4. The counterbalancing weight 50 can be a lead pipe or the like or can be filled with weighted filler material, such as sand, stone, cement or the like. A cap 52 can be applied to the free open end 54 of the rear section 48 to enclose the weight 50.

Figure 3:
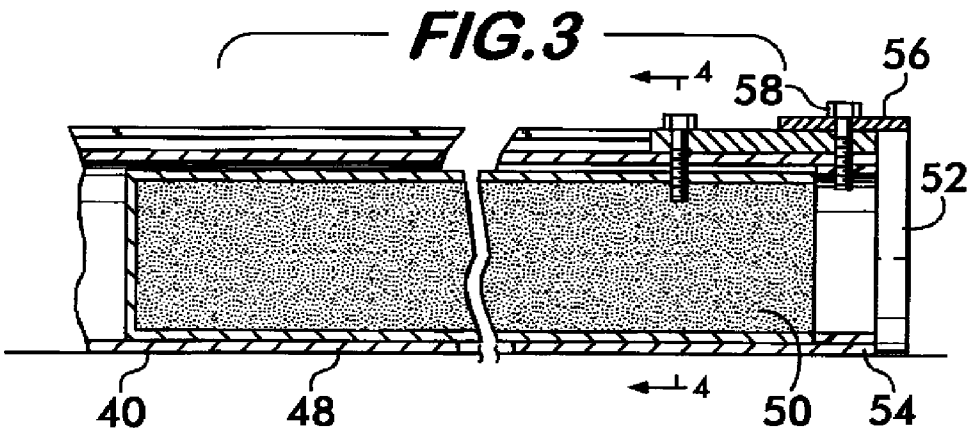
FIG. 3 is a cross-sectional view along line 3-3 of FIG. 1.
Figure 2:
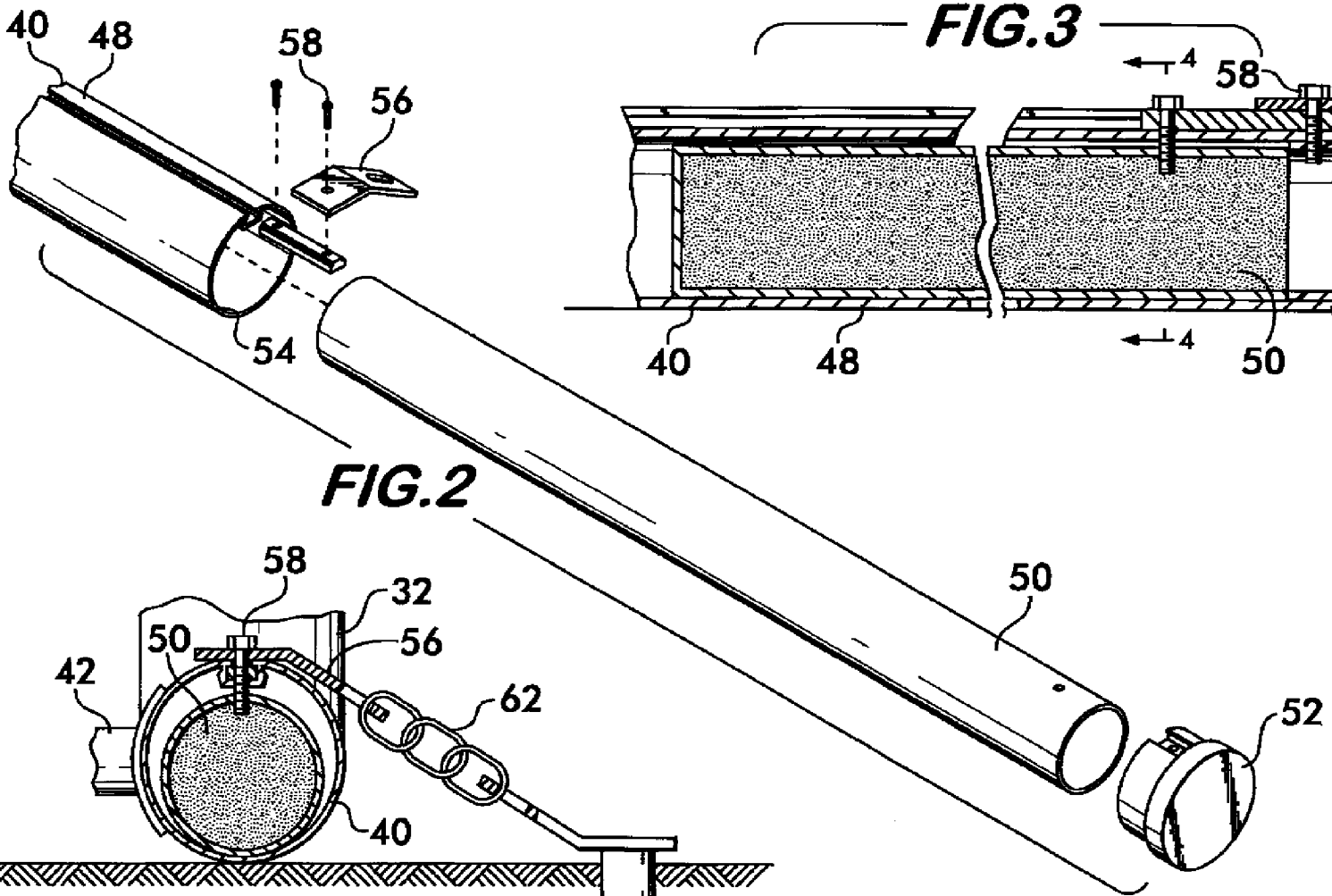
FIG. 2 is an exploded perspective view of a back bar and counterbalancing weight of the soccer goal according to the present invention.
Figure 4:
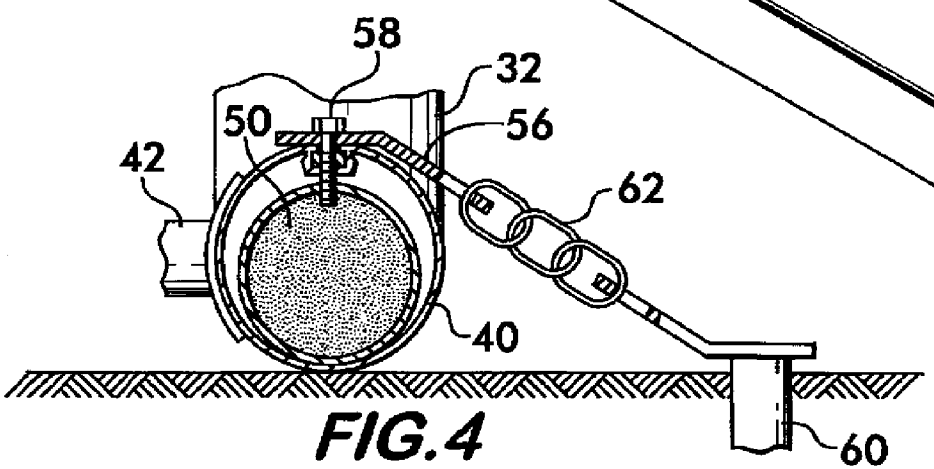
FIG. 4 is a cross-sectional view along line 4-4 of FIG. 4.

The above referenced counterbalancing weights 50 are particularly useful when the goal 12 is located on artificial turf or like surface in which ground anchors cannot readily be used. However, if the goal 12 is used on a natural surface, additional ground anchors can be used to secure the goal 12 to the ground. For instance as shown in FIGS. 2-4, a bracket 56 can be secured with a fastener 58 or the like to the rear section 48 of the base rail 40 to tether the rear section 48 to a ground anchor 60 via a chain 62 or like connecting element. This provides further security against tipping of the goal 12.

By way of example, and not by way of limitation, the goal posts 32, cross bar 34, and base rails 40 can be four inch outer diameter, round, hollow elongate posts made of aluminum or like material. Tubes of square or other cross-sections or other diameters can also be utilized. Each of the goal posts 32 and base rails 40 can be of substantially the same length, for instance, about eight feet in length, and the crossbar 34 and base crossbar 42 can be about twenty-four feet in length. The base crossbars can have front sections 46 of about five feet in length and rear sections 48 of about three feet or more in length. Of course, other dimensions can be utilized. The corners of the goal are preferably welded for strength and durability, and so-called "European style" backstays 64 are secured to the upper ends of the goal posts to recess the net 38 from the upper end of the goalmouth. Counterbalancing weights 50 each weighting about seventeen pounds (for a total of about thirty-four lbs per goal) can be inserted into the rear sections 48 of the hollow base rails 40, and the entire weight of the goal 12 can be made to be about 212 pounds. Of course other sizes of weights as well as ground anchors can also be utilized provided the goal is readily removable and replaceable relative to the playing field.

Preferably, each of the goal posts 32, crossbar 34, base rails 40 and base crossbar 42 includes a longitudinally-extending inset channel capable of receiving the perimeter rope of the goal net 38 which can be removably secured thereto with clips or fasteners that engage the channel. Such a net fastening system is described in U.S. Pat. Nos. 5,476,266 and 7,241,235 B2 issued to Caruso which are owned by Kwik Goal Ltd., the assignee of the present application, and which is incorporated herein by reference. The KWIK LOCK Net Channel System has proven to be commercially successful due to the ease with which nets can be secured and removed from goal frames.

While preferred goal assemblies and goal arrangements for a shared field have been described in detail, various modifications, alterations, and changes may be made without departing from the spirit and scope of the assemblies according to the present invention as defined in the appended claims.

The invention claimed is:

1. A sports goal assembly for use on a playing field, comprising a goal frame defining an upright goal mouth relative to the playing field and a goal net secured to said goal frame including a part of said goal frame defining said goal mouth, said goal frame including:

a spaced-apart, opposed pair of elongate base rails that each extend rearward of said goal mouth and along and parallel to the underlying surface of the playing field; and an elongate base crossbar that interconnects said base rails and that extends transversely therebetween;

each of said elongate base rails being of a length including a front section adjacent said goal mouth, a rear section remote from said goal mouth, and an intermediate section located between said front and rear sections; and said base crossbar being connecting to and extending from said intermediate sections of said base rails;

said rear sections of said base rails being of greater weight than said front sections to counterbalance said goal assembly; and said goal net being secured to said crossbar and said front sections of each of said base rails, but not said rear sections of said base rails wherein said base crossbar and base rails are arranged to form a substantially I-shaped configuration and wherein each of said base rails is a hollow elongate tube, and further comprising counterbalancing weights that are positioned only within said hollow rear sections of said base rails.

2. A sports goal assembly according to claim 1, wherein each of said rear sections of said base rails is at least about 3 feet in length.

3. A sports goal assembly according to claim 2, wherein said goal frame includes a spaced-apart pair of upright goal posts and a crossbar that defines said goal mouth, and wherein said base rails interconnect to and extend from a rear side of lower ends of said upright goal posts.

4. A shared soccer/football playing field endline assembly, comprising:

football uprights including a support post projecting from a ground surface a spaced distance behind an endline of a playing field; and a soccer goal positioned on said ground surface between said support post of said football uprights and said endline of said playing field and providing an upright goalmouth on said endline;

said soccer goal having a frame including a pair of spaced-apart upright goal posts and a crossbar that together define said goalmouth, a spaced-apart pair of elongate base rails extending rearward from lower ends of said goal posts, and a base crossbar interconnecting said pair of base rails and extending transversely therebetween;

each of said elongate base rails being of a length including a front section adjacent said goalmouth, a rear section remote from said goal mouth, and an intermediate section located between said front and rear sections; and said rear sections of said base rails being located a greater distance behind said endline of said playing field then said support post of said football uprights, and said base crossbar extending from said intermediate sections of said base rails at a location between said endline of said playing field and said support post of said football uprights;

said soccer goal including a goal net secured only to said upright goal posts, crossbar, base crossbar, and said front sections of said base rails of said frame of said soccer goal such that said goal net extends only between said endline and said support post of said football uprights and is a spaced distance from said support post of said football uprights; and said rear sections of said base rails being of greater weight than said front sections to counterbalance said goal assembly wherein said base crossbar and base rails are arranged in a substantially I-shaped configuration and wherein each of said base rails is a hollow elongate tube, and further comprising counterbalancing weights that are positioned only within said hollow rear sections of said base rails.

5. A shared soccer/football playing field endline assembly according to claim 4, wherein each of said rear sections of said base rails is at least about 3 feet in length.

6. A shared soccer/football playing field endline assembly according to claim 5, wherein said football uprights include a crossbar and a pair of upright goal posts that extend directly above said endline of said playing field and said goalmouth of said soccer goal.

7. A shared soccer/football playing field endline assembly according to claim 6, wherein said soccer goal is portable and removable from said playing field when said playing field is used for football.

* * * * *